US011319177B2

(12) United States Patent
Maruyama

(10) Patent No.: US 11,319,177 B2
(45) Date of Patent: May 3, 2022

(54) SENSOR UNIT AND IMAGE FORMING APPARATUS THEREWITH

(71) Applicant: KYOCERA Document Solutions Inc., Osaka (JP)

(72) Inventor: Kei Maruyama, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 254 days.

(21) Appl. No.: 16/663,937

(22) Filed: Oct. 25, 2019

(65) Prior Publication Data

US 2020/0140216 A1 May 7, 2020

(30) Foreign Application Priority Data

Nov. 2, 2018 (JP) ..... JP2018-207106

(51) Int. Cl.
*B65H 5/36* (2006.01)
*B65H 7/14* (2006.01)
*B65H 7/02* (2006.01)

(52) U.S. Cl.
CPC ..... *B65H 5/36* (2013.01); *B65H 7/02* (2013.01); *B65H 7/14* (2013.01); *B65H 2404/611* (2013.01); *B65H 2511/13* (2013.01); *B65H 2553/416* (2013.01); *B65H 2553/80* (2013.01)

(58) Field of Classification Search
CPC ..... B65H 5/36; B65H 7/14; B65H 2404/611; B65H 2553/80
See application file for complete search history.

(56) References Cited

U.S. PATENT DOCUMENTS 9,674,389 B2 * 6/2017 Kanaya ..... B65H 7/14
9,802,776 B2 * 10/2017 Fukusaka ..... G03G 15/703
11,008,188 B2 * 5/2021 Morikawa ..... B65H 5/36
11,225,090 B2 * 1/2022 Osawa ..... G01N 29/262
(Continued)

FOREIGN PATENT DOCUMENTS

CN 1755532 A 4/2006
CN 201062173 Y 5/2008
(Continued)

OTHER PUBLICATIONS

Chinese Office Action dated Jan. 27, 2021, issued by the China National Intellectual Property Administration in corresponding application CN 201911016120.X.
(Continued)

*Primary Examiner* — Patrick Cicchino
(74) *Attorney, Agent, or Firm* — Stein IP, LLC

(57) ABSTRACT

A sensor unit includes a first housing constituting a first conveying face of a sheet conveying passage, a second housing constituting a second conveying face arranged opposite the first conveying face with a predetermined gap, an edge detection sensor detecting a side edge along the sheet conveying direction, and a gap adjuster supporting the first housing movably in a direction in which the size of the gap increases. When, with the first housing arranged at the first position, a sheet with a thickness greater than a reference value passes through the sheet conveying passage, the first housing moves in the direction in which the size of the gap increases as the sheet enters the sheet conveying passage, to allow the passage of the sheet.

13 Claims, 12 Drawing Sheets

(56) References Cited

U.S. PATENT DOCUMENTS

| | | | | |
|---|---|---|---|---|
| 2006/0072950 | A1 | 4/2006 | Lim et al. | 399/388 |
| 2019/0063901 | A1 * | 2/2019 | Mitsui | B65H 5/36 |
| 2020/0198910 | A1 * | 6/2020 | Takato | B65H 5/36 |

FOREIGN PATENT DOCUMENTS

| | | | |
|---|---|---|---|
| CN | 206552930 | U | 10/2017 |
| JP | 2011-176669 | A | 9/2011 |
| WO | WO-2018105325 | A1 * | 6/2018 |

OTHER PUBLICATIONS

Chinese Office Action dated Oct. 15, 2021, issued by the China National Intellectual Property Administration in corresponding application CN 201911016120.X.

* cited by examiner

SENSOR UNIT AND IMAGE FORMING APPARATUS THEREWITH

INCORPORATION BY REFERENCE

This application is based upon and claims the benefit of priority from the corresponding Japanese Patent Application No. 2018-207106 filed on Nov. 2, 2018, the contents of which are hereby incorporated by reference.

BACKGROUND

The present disclosure relates to a sensor unit which is incorporated in image forming apparatuses such as facsimile machines, copiers, and printers and which includes a sensor for sensing the edge of a sheet. The present disclosure also relates to image forming apparatuses provided with such a sensor unit.

Image forming apparatuses such as facsimile machines, copiers, and printers are configured to record an image on a sheet such as paper, cloth, or an OHP sheet. These image forming apparatuses can be classified into an electrophotographic type, an ink-jet type, etc. based on their recording method.

During printing on a sheet using an image forming apparatus, if the sheet deviates in the direction (sheet width direction) perpendicular to the conveying direction, the printing position changes from one sheet to another. Thus, for example in a case where binding is performed after printing, high accuracy in the printing position on each page is required.

Thus, there are known image forming apparatuses provided with an edge detection sensor comprising a CIS (contact image sensor) or the like which is arranged opposite a sheet conveying passage and which detects the side edge along the sheet conveying direction of a sheet, a lighting device which is arranged on the same side as or on the opposite side from the edge detection sensor with respect to the sheet conveying passage and which emits light toward the sheet conveying passage, an upper guide member which constitutes the top face of the sheet conveying passage, and a lower guide member which constitutes the bottom face of the sheet conveying passage. This image forming apparatus senses the position of an end part of a sheet in its width direction based on the difference in the intensity of the light received by the edge detection sensor according to presence or absence of the sheet.

A conventional image forming apparatus is disclosed which is provided with an edge detection sensor for detecting the position of an end part of a sheet in the width direction and upper and lower guide members which constitute the top and the bottom faces, respectively, of the sheet conveying passage.

SUMMARY

According to one aspect of what is disclosed herein, a sensor unit includes a sheet conveying passage through which a sheet is conveyed; a first housing which extends in the width direction perpendicular to the conveying direction of the sheet and which constitutes a first conveying face of the sheet conveying passage; a second housing which extends in the width direction and which constitutes a second conveying face of the sheet conveying passage arranged opposite the first conveying face with a predetermined gap; an edge detection sensor which is arranged in one of the first and second housings and which detects the side edge, along the conveying direction, of the sheet passing through the sheet conveying passage; and a gap adjuster which supports the first housing movably from a first position where the size of the gap equals a reference value in the direction in which the size of the gap increases from the reference value. When, with the first housing arranged at the first position, a sheet with a thickness greater than the reference value passes through the sheet conveying passage, the first housing moves in the direction in which the size of the gap increases as the sheet enters the sheet conveying passage, to allow passage of the sheet.

This and other objects of the present disclosure, and the specific benefits obtained according to the present disclosure, will become apparent from the description of embodiments which follows.

DETAILED DESCRIPTION

Hereinafter, with reference to the accompanying drawings, embodiments of the present disclosure will be described.

Figure 1:
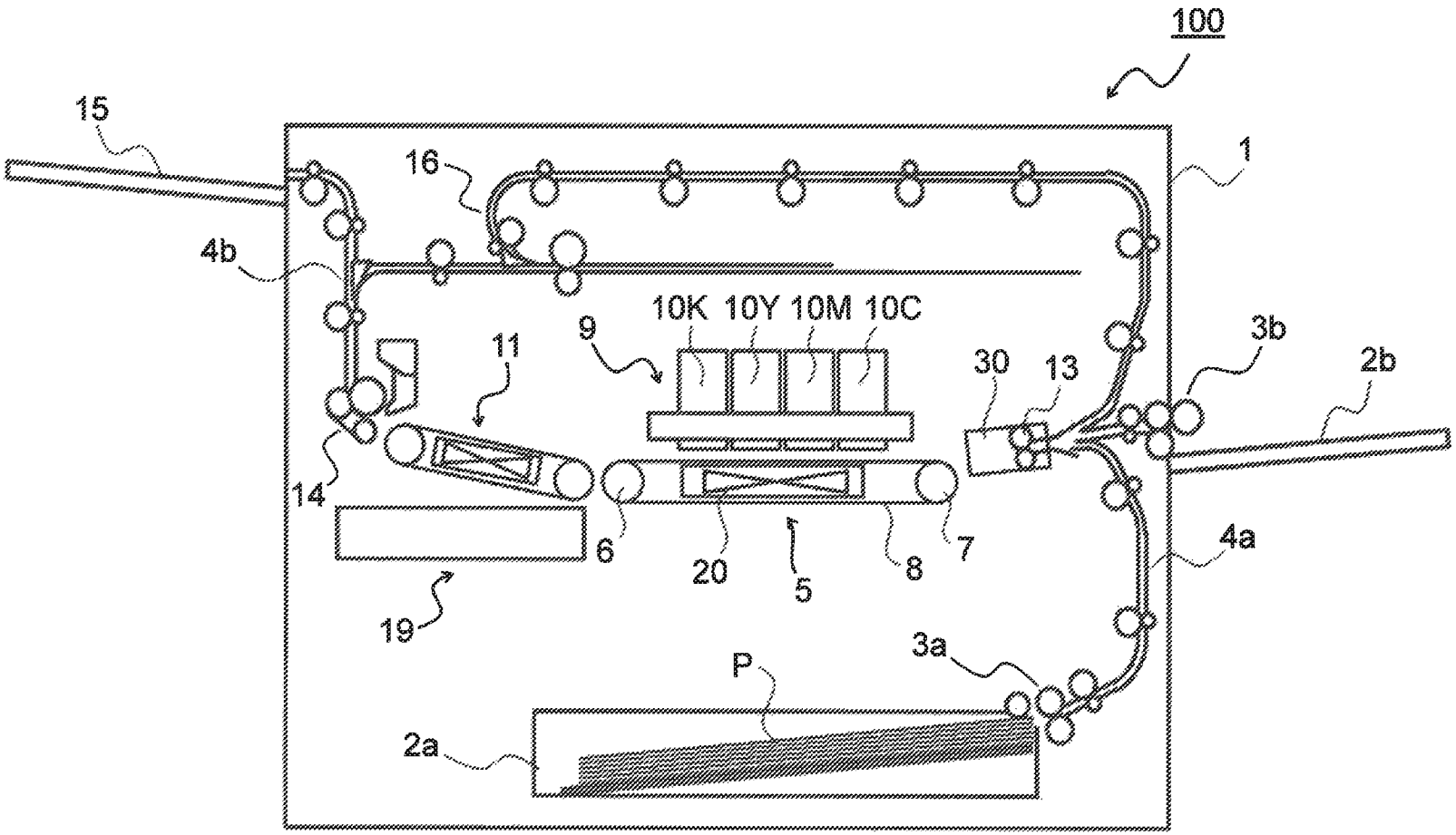
FIG. 1 is a cross-sectional side view showing the overall construction of a printer provided with a sensor unit according to one embodiment of the present disclosure.

FIG. 1 is a cross-sectional side view showing the overall construction of a printer (an image forming apparatus) 100 of an ink-jet recording type provided with a sensor unit 30 according to one embodiment of the present disclosure.

As shown in FIG. 1, the printer 100 has a sheet feeding cassette 2*a* as a sheet storage portion arranged in a lower part inside a printer main body 1, and on the outside of the right side face of the printer main body 1, a manual feed tray 2*b* is provided. On the downstream side of the sheet feeding cassette 2*a* in the sheet conveying direction (on the right side of the sheet feeding cassette 2*a* in FIG. 1), a sheet feeding device 3*a* is arranged. On the downstream side of the manual feed tray 2*b* in the sheet conveying direction (on the left side of the manual feed tray 2*b* in FIG. 1), a sheet feeding device 3*b* is arranged. By the sheet feeding devices 3*a* and 3*b*, sheets P are separated and fed out one after another.

Inside the printer 100, a first sheet conveying passage 4*a* is provided. The first sheet conveying passage 4*a* is located to the upper right of the sheet feeding cassette 2*a*, and to the left of the manual feed tray 2*b*. Sheets P fed out of the sheet feeding cassette 2*a* are conveyed vertically upward along a side face of the printer main body 1 via the first sheet conveying passage 4*a*, and sheets fed out of the manual feed tray 2*b* are conveyed to the left in a substantially horizontal direction via the first sheet conveying passage 4*a*.

At the downstream end of the first sheet conveying passage 4*a* in the sheet conveying direction, the sensor unit 30 for sensing the side edge (the position of an end part in the width direction (the direction perpendicular to the sheet conveying direction)) along the sheet conveying direction of sheets P is arranged. On the downstream side of the sensor unit 30, close to it, a first belt conveying portion 5 and a recording portion (an image forming portion) 9 are arranged.

In the sensor unit 30, a registration roller pair 13 is provided. The registration roller pair 13, while correcting skewed conveying of sheets P and coordinating with the timing of ink ejecting operation by the recording portion 9, feeds out the sheets P toward the first belt conveying portion 5. The structure of the sensor unit 30 will be described in detail later.

The first belt conveying portion 5 is provided with an endless first conveying belt 8 that is wound around a first driving roller 6 and a first driven roller 7. In the first conveying belt 8, a large number of vent holes (unillustrated) for sucking in air are provided. A sheet P fed out from the registration roller pair 13 is, while being held by suction on the first conveying belt 8 by a sheet suction portion 20 provided inside the first conveying belt 8, passes under the recording portion 9.

The recording portion 9 includes line heads 10C, 10M, 10Y and 10K. The line heads 10C to 10K record an image on a sheet P conveyed while being held by suction on the conveying face of the first conveying belt 8. To the line heads 10C to 10K, ink of four colors (cyan, magenta, yellow, and black) stored in ink tanks (unillustrated) is supplied such that ink of the different colors are supplied to corresponding ones of the line heads 10C to 10K respectively.

Toward a sheet P sucked on the first conveying belt 8, ink of the respective colors is sequentially ejected from the line heads 10C to 10K, and thereby a full-color image having ink of four colors, namely yellow, magenta, cyan, and black, overlaid together is recorded on the sheet P. The printer 100 can record also a monochrome image by using only black ink.

On the downstream side (left side in FIG. 1) of the first belt conveying portion 5 in the sheet conveying direction, a second belt conveying portion 11 is arranged. A sheet P having an image recorded on it at the recording portion 9 is conveyed to the second belt conveying portion 11. While the sheet P passes through the second belt conveying portion 11, the ink ejected on the surface of the sheet P is dried. Since the configuration of the second belt conveying portion 11 is similar to that of the first belt conveying portion 5, no overlapping description will be repeated.

On the downstream side of the second belt conveying portion 11 in the sheet conveying direction, near the left side face of the printer main body 1, a decurler portion 14 is provided. The sheet P with the ink dried at the second belt conveying portion 11 is conveyed to the decurler portion 14 so that the curled sheet P is straightened.

On the downstream side (in an upper part in FIG. 1) of the decurler portion 14 in the sheet conveying direction, a second sheet conveying passage 4*b* is provided. The sheet P that has passed through the decurler portion 14 is, when not subjected to double-sided recording, discharged from the second sheet conveying passage 4*b* via the discharge roller pair to a sheet discharge tray 15 provided outside the left side face of the printer 100. When recording is performed on both sides of a sheet P, the sheet P having undergone recording on its first side and having passed through the second belt conveying portion 11 and the decurler portion 14 is conveyed via the second sheet conveying passage 4*b* to a reversing conveying passage 16. The sheet P conveyed to the reversing conveying passage 16 has its conveying direction switched so as to be reversed between its obverse and reverse sides, and is conveyed to the registration roller pair 13 via an upper part of the printer 100. Then, with the face on which no image has been recorded yet pointing up, the sheet P is conveyed to the first belt conveying portion 5 again.

Under the second belt conveying portion 11, a maintenance unit 19 is arranged. The maintenance unit 19, when performing maintenance of the respective recording heads of the line heads 10C to 10K, moves to under the recording portion 9, where it wipes off the ink ejected (purged) from ejection nozzles in the recording heads and collects the wiped-off ink.

Figure 2:
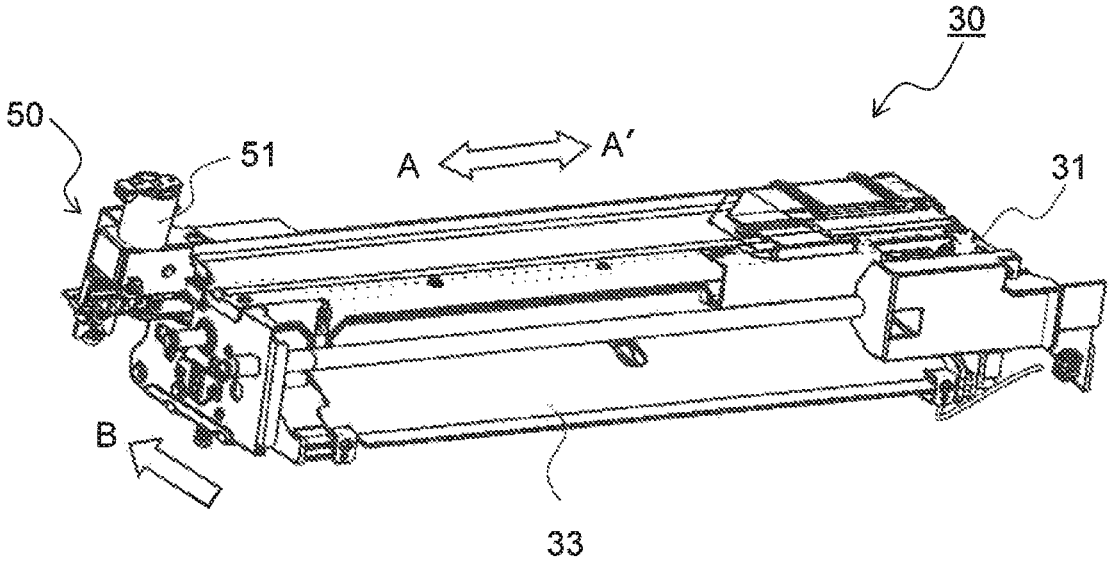
FIG. 2 is an exterior perspective view of the sensor unit according to the one embodiment of the present disclosure.
Figure 3:
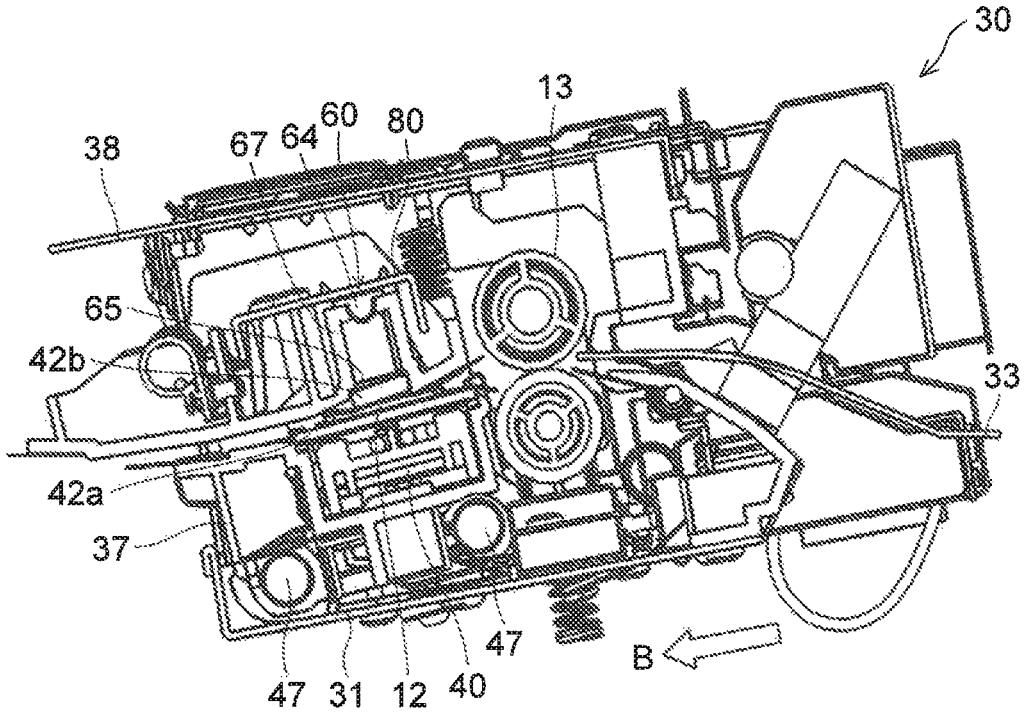
FIG. 3 is a cross-sectional side view of the sensor unit according to the one embodiment of the present disclosure.
Figure 4:
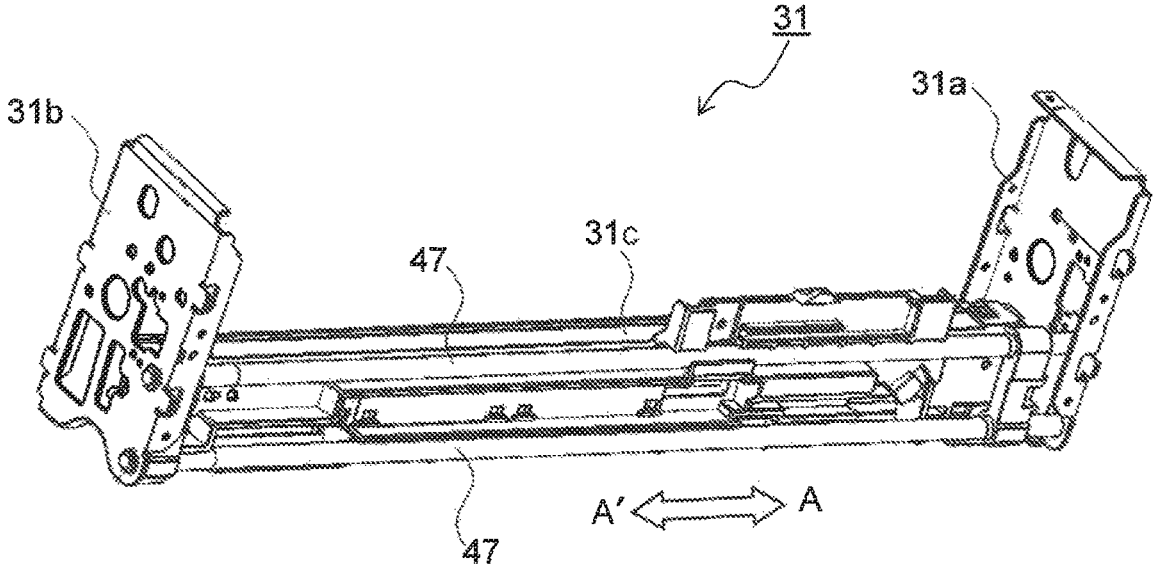
FIG. 4 is a perspective view of a frame constituting a unit housing of the sensor unit according to the one embodiment of the present disclosure.

Next, the structure of the sensor unit 30 will be described in detail. FIG. 2 is an exterior perspective view of the sensor unit 30 according to one embodiment of the present disclosure. FIG. 3 is a cross-sectional side view of the sensor unit 30 according to one embodiment of the present disclosure. FIG. 4 is a perspective view of the frame constituting a unit housing 31 of the sensor unit 30 according to one embodiment of the present disclosure.

The sensor unit 30 is provided with the unit housing 31, the registration roller pair 13, a CIS carriage main body 37, and a carriage moving mechanism 50. The unit housing 31 supports the registration roller pair 13 so as to be rotatable as well as supports the CIS carriage main body 37 so as to be movable in the sheet width direction (in the arrow AA' direction). In an upstream-side end part of the unit housing 31 in the sheet conveying direction (in the arrow B direction), there is provided a registration entrance guide 33 that guides sheets P to a nip portion of the registration roller pair 13.

As shown in FIG. 4, the unit housing 31 includes side face frames 31*a* and 31*b* that are arranged on the front side and the rear side, respectively, of the printer 100 and a coupled frame 31*c* that is coupled with the side face frames 31*a* and 31*b* so as to bridge between them. Between the side face frame 31*a* and 31*b*, two shafts 47 that slidably support the CIS carriage main body 37 in the sheet width direction (in the arrow AA' direction) are fixed parallel to each other.

The CIS carriage main body 37 is arranged adjacent to a part (left-side in FIG. 3) downstream of the registration roller pair 13 in the sheet conveying direction (in the arrow B direction). The CIS carriage main body 37 houses a CIS (edge detection sensor) 40 and a lighting device 60. As shown in FIG. 3, the CIS 40 and the lighting device 60 are housed in a lower part and an upper part, respectively, inside the carriage main body 37, and between the CIS 40 and the lighting device 60, two transparent contact glasses 42*a* and 42*b* are arranged so as to face each other. The top face of the contact glass 42*a* and the bottom face of the contact glass 42*b* form a part of a sheet conveying passage 12.

The CIS 40, based on the light intensity difference between the part that is struck by the light from the lighting device 60 and the part that is intercepted by a sheet P, senses the side edge of a sheet P in its width direction. The structure of the lighting device 60 will be described in detail later.

Figure 5:
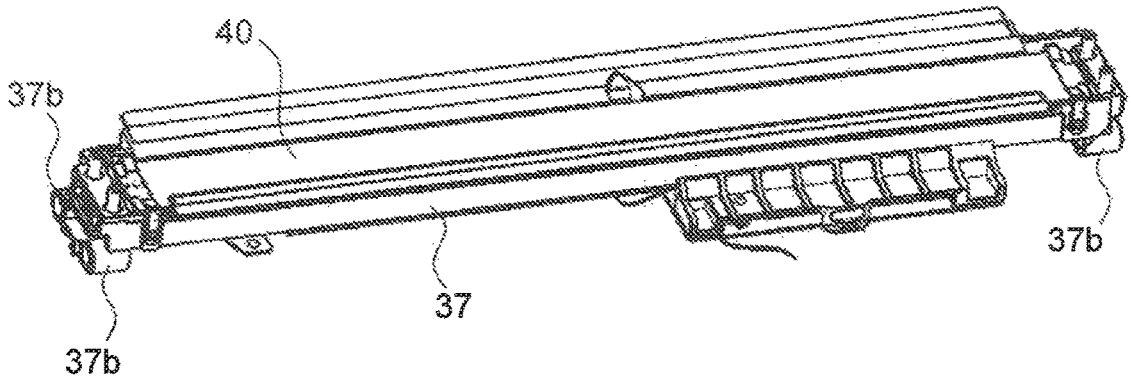
FIG. 5 is an exterior perspective view showing a state in which a CIS is mounted on a CIS carriage main body.
Figure 6:
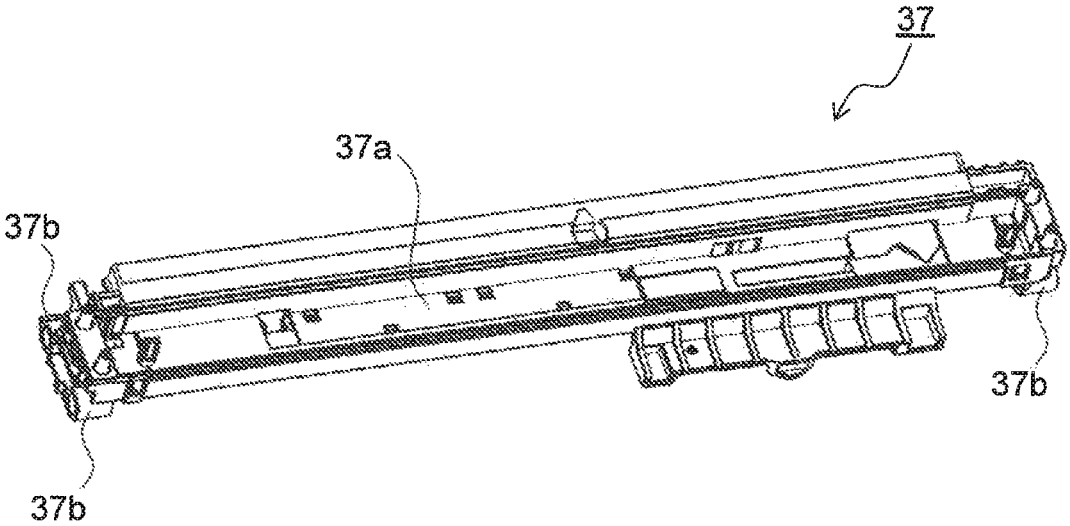
FIG. 6 is an exterior perspective view of the CIS carriage main body.
Figure 7:
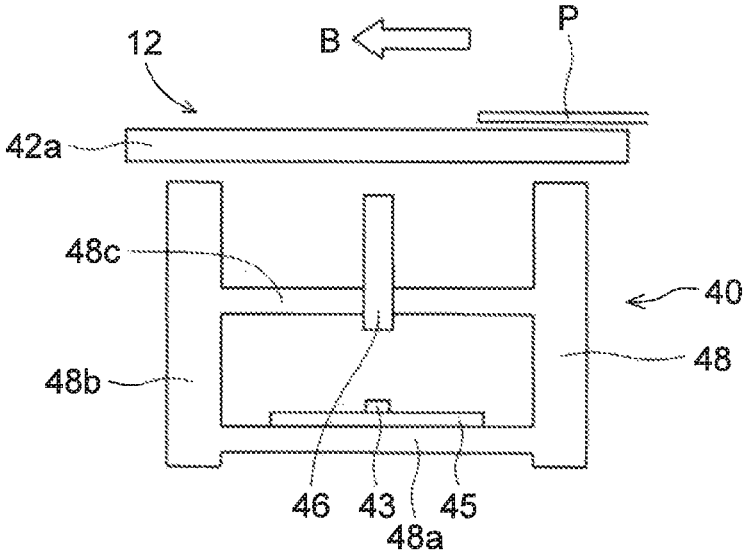
FIG. 7 is a cross-sectional side view of the structure around the CIS.
Figure 8:
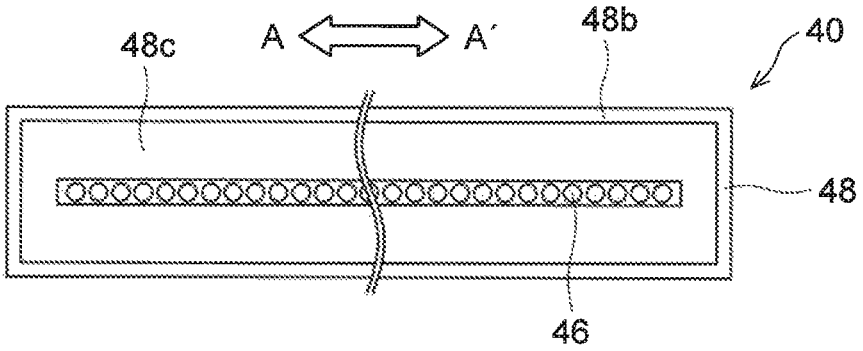
FIG. 8 is a plan view of the CIS as seen from above.
Figure 9:
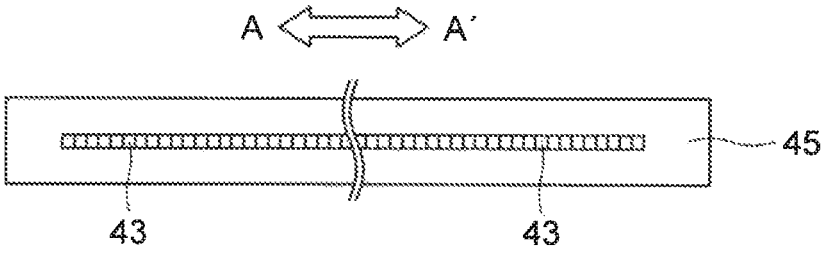
FIG. 9 is a plan view of the structure of a light receiving portion of the CIS and a CIS substrate as seen from above.

FIG. 5 is an exterior perspective view showing a state in which the CIS 40 is mounted on the CIS carriage main body 37. FIG. 6 is an exterior perspective view of the CIS carriage main body 37. FIG. 7 is a cross-sectional side view of the structure around the CIS 40. FIG. 8 is a plan view of the CIS 40 as seen from above. FIG. 9 is a plan view of the structure of a light receiving portion 43 of the CIS 40 and a CIS substrate 45 as seen from above.

The CIS carriage main body 37 includes a CIS housing portion 37*a* in which the CIS 40 is housed and shaft guide portions 37*b* in which the shafts 47 of the unit housing 31 are slidably inserted. The CIS housing portion 37*a* is provided substantially over the entire region of the CIS carriage main body 37 in its longitudinal direction. There are provided two shaft guide portions 37*b* at each end part of the CIS carriage main body 37 in its longitudinal direction, that is, two pairs of the shaft guide portions 37*b* in the sheet conveying direction.

As shown in FIGS. 7 to 9, the CIS 40 includes a plurality of light receiving portions 43 which are arrayed in the sheet width direction (in the arrow AA' direction) with a predetermined pitch and which are composed of photoelectric conversion elements, the CIS substrate 45 on the top face of which the light receiving portions are mounted, a rod lens array 46 composed of a plurality of rod lenses arrayed in the sheet width direction, and a CIS housing 48 which houses these.

The CIS housing 48 has a bottom face portion 48*a*, a side face portion 48*b* which is erect from the peripheral edge of the bottom face portion 48*a*, and a supporting face portion 48*c* arranged at a predetermined distance from the bottom face portion 48*a*. The CIS substrate 45 is fixed on the bottom face portion 48*a*. The rod lenses in the rod lens array 46 are formed in a cylindrical shape and are arranged on the sheet conveying passage 12 side (on the upper side) with respect to the light receiving portion 43. The rod lens array 46 penetrates the supporting face portion 48*c* and is fixed to the supporting face portion 48*c* at a predetermined distance from the light receiving portion 43. The rod lens array 46 guides the light from the lighting device 60 to the light receiving portion 43.

Next, the structure of the lighting device 60 will be described in detail.

Figure 10:
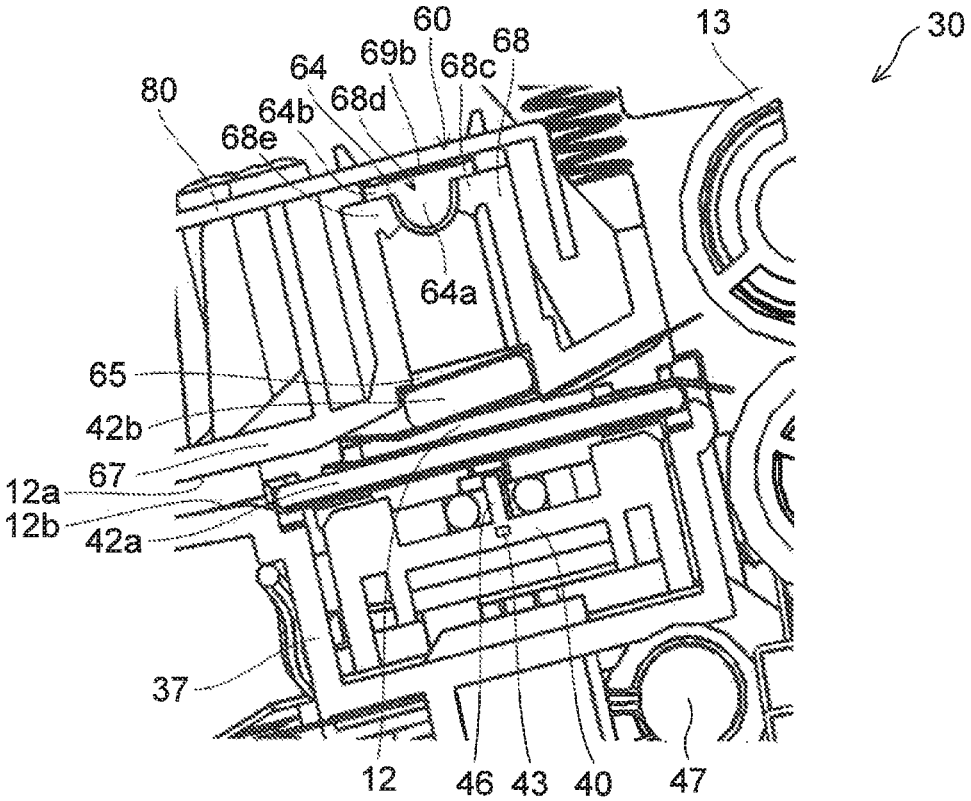
FIG. 10 is a cross-sectional side view showing the structure around a lighting device of the sensor unit according to one embodiment of the present disclosure.

As shown in FIG. 10, the lighting device 60 includes one LED (a light source) 62 (see FIG. 11) arranged at one end part of it in the sheet width direction, a light guide body 64 which extends in the sheet width direction and which guides the light emitted from the LED 62 in the sheet width direction to shine it toward the CIS 40, a light diffusion plate 65 in a sheet form which diffuses the light from the light guide body 64 to shine it onto the CIS 40, and a lighting housing 67 which supports these.

The lighting housing 67 has a function as a sheet guide which forms a part of the sheet conveying passage 12 and a function as a light guide body holding member which supports the light guide body 64. The lighting housing 67 includes a stay 68 which protrudes in such a direction as to retract from the sheet conveying passage 12 (upward). The stay 68 extends in the sheet width direction and is, by being surrounded by a top face portion 68*c* and a pair of side face portions so as to open downward, formed in a shape with a substantially rectangular cross section. In the top face portion 68*c* of the stay 68, a slit 68*d*, in which a light guide portion 64*a*, described later, of the light guide body 64 is arranged, is formed so as to extend in the sheet width direction.

A contact glass 42*b* is fixed to the lighting housing 67 using clips or the like (unillustrated), and the bottom face of the contact glass 42*b* and the bottom face of the lighting housing 67 form the top face (first conveying face) 12*a* of the sheet conveying passage 12. The contact glass 42*a* is placed on the CIS carriage main body 37. The top face of the contact glass 42*a* and the top face of the CIS carriage main body 37 form the bottom face (second conveying face) 12*b* of the sheet conveying passage 12. The lighting housing 67 is one example of a "first housing" according to the present disclosure, and the CIS carriage main body 37 is one example of a "second housing" according to the present disclosure.

Figure 11:
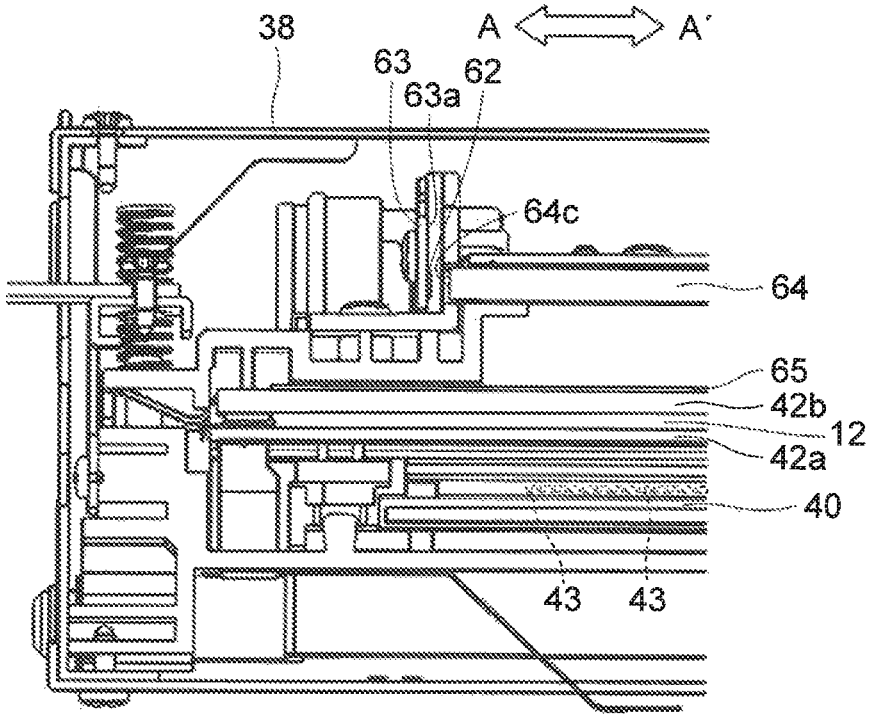
FIG. 11 is a cross-sectional view showing the structure around an LED of the sensor unit according to the one embodiment of the present disclosure.

As shown in FIG. 11, an LED 62 is mounted on a mounting face 63*a* of an LED substrate 63. The LED 62 emits light vertically with respect to the mounting face 63*a* of the LED substrate 63. The LED substrate 63 is fixed to the lighting housing 67 using screws.

Figure 12:
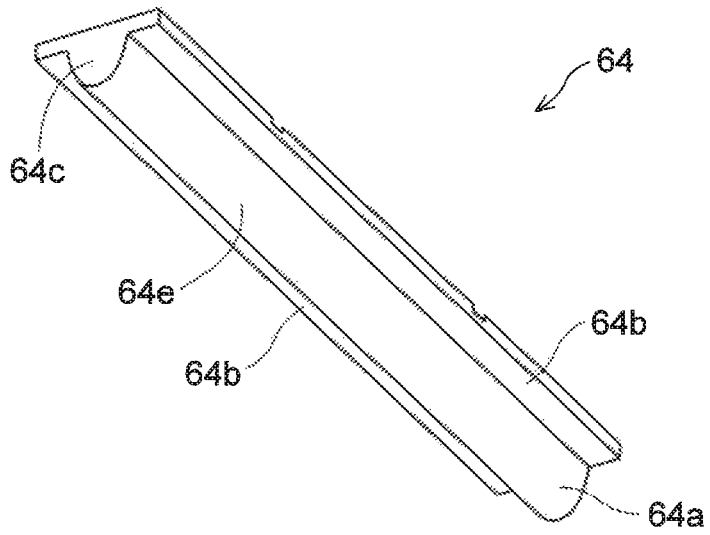
FIG. 12 is a perspective view showing the structure of a light guide body of the sensor unit according to the one embodiment of the present disclosure as seen from the light exit face side.
Figure 13:
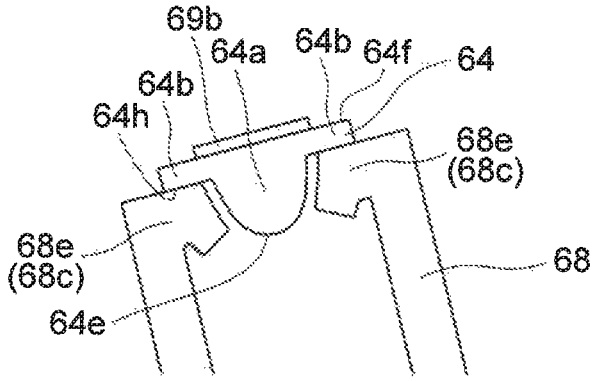
FIG. 13 is a cross-sectional side view showing the structure around the light guide body of the sensor unit according to the one embodiment of the present disclosure.
Figure 14:
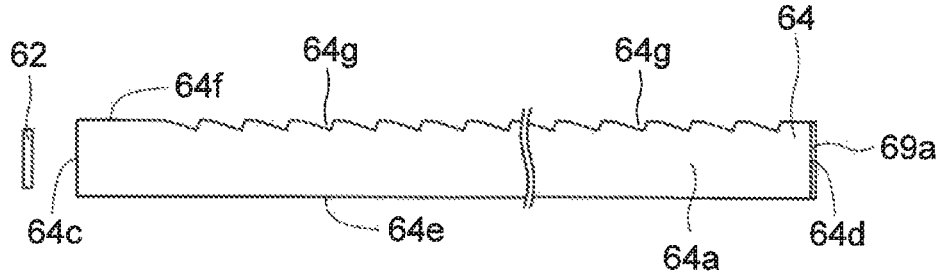
FIG. 14 is a cross-sectional view showing the structure around the light guide body of the sensor unit according to the one embodiment of the present disclosure.

As shown in FIGS. 12 and 13, the light guide body 64 has the light guide portion 64*a* which extend in the sheet width direction and which guides light, and a pair of flange portions 64*b* which is formed integrally with the light guide portion 64*a* and which projects from its rear face 64*f*, described later, in opposite directions along the direction (the left-right direction in FIG. 13) perpendicular to the sheet width direction while extending in the sheet width direction. The light guide portion 64*a* is formed so as to bulge in a U shape from the flange portion 64*b*. As shown in FIGS. 12 and 14, the light guide portion 64*a* includes a light receiving face 64*c* which is arranged so as to face the LED 62 to receive the light from the LED 62, an opposite face 64*d* (see FIG. 14) provided at an end part of the side opposite from the LED 62, a light exit face 64*e* with a curved surface which is provided on the CIS 40 side (lower side) side face of and which transmits the light entered through the light receiving face 64*c* toward the sheet conveying passage 12, and a flat rear face (top face) 64*f* arranged opposite from the light exit face 64*e*.

On the opposite face 64*d*, a reflection sheet 69*a* for reflecting the light exiting through the opposite face 64*d* to shine the light back into the guide body 64 is provided. On the rear face 64*f*, a plurality of concave prisms 64*g* are formed which are arrayed in the sheet width direction and which totally reflect the light entered through the light receiving face 64*c* toward the light exit face 64*e*.

As shown in FIGS. 10 and 11, the light diffusion plate 65 is supported on the top face of the contact glass 42*b*. Both end parts of the light diffusion plate 65 in the sheet width direction and an upstream-side end part of it in the sheet conveying direction are held between the contact glass 42*b* and the lighting housing 67. This helps reduce the number of components compared to in a case where members for supporting the light diffusion plate 65 are arranged separately.

The light emitted from the LED 62 enters the light guide body 64 and is guided in the sheet width direction to exit toward the sheet conveying passage 12. The light is then diffused by the light diffusion plate 65 and is transmitted through the contact glasses 42*b* and 42*a* to be shone into the CIS 40. The light diffusion plate 65 is a transmission type light diffusion plate which transmits the light from the light guide body 64.

Owing to the provision of the light diffusion plate 65 for diffusing the light exited from the light guide body 64, even when the light exited from the light guide body 64 is uneven, it is possible to make the light even with the light diffusion plate 65. This makes it possible to reduce the increase, resulting from uneven light, of the difference in the intensity of the light received at the CIS 40.

Figure 15:
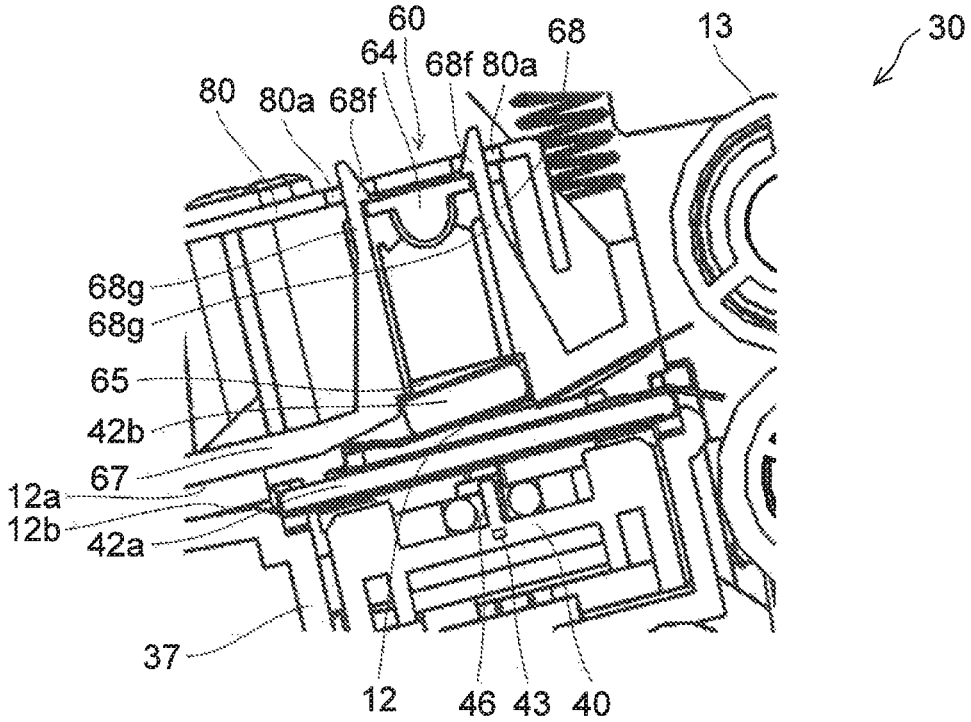
FIG. 15 is a cross-sectional side view showing the structure around the lighting device of the sensor unit according to the one embodiment of the present disclosure.

As shown in FIGS. 13 and 15, the stay 68 includes a pair of supporting portions 68*e* which supports a CIS 40 side supported face 64*h* of the flange portion 64*b* of the light guide body 64, and a plurality of pairs of engaging pieces 68*g* which are provided so as to protrude upward beyond the supporting portion 68*e* and which engage with the flange portion 64*b*.

The pair of supporting portions 68*e* is formed so as to extend in the sheet width direction and is arranged so as to face each other across the light guide portion 64*a*, The supporting portions 68*e* have a function as a light shielding member which, when the LED light that has passed from the light guide portion 64*a* into the flange portion 64*b* or the external disturbance light that has passed from the rear face 64*f* into the flange portion 64*b* exits through the supported face 64*h* of the flange portion 64*b* to the CIS 40, shields the light.

As shown in FIG. 15, the engaging pieces 68*g* are formed in what is called a snap fit structure. Each engaging piece 68*g* has, at its tip end portion, an engaging claw 68*f* which engages with the face (top face) of the flange portion 64*b* opposite from the CIS 40 and is elastically deformable in the direction (left-right direction in FIG. 15, sheet conveying direction) perpendicular to the protruding direction.

As shown in FIG. 13, on the rear face 64*f* of the light guide body 64, a reflection plate 69*b* which reflects the light exited from the light guide body 64 toward the light exit face 64*e* to shine it back into the light guide body 64 is arranged. The reflective face (bottom face) of the reflection plate 69*b* may be formed so as to irregularly reflect light. As shown in FIG. 10, a reflection plate holding member 80 made of sheet metal which, together with the light guide body 64, clamps and holds the reflection plate 69*b* in between is arranged so as to cover the rear face 64*f* side (upper side) of the light guide body 64. The reflection plate holding member 80 is fixed to the lighting housing 67 using screws. As shown in FIG. 15, in the reflection plate holding member 80, a plurality of openings 80*a* are formed in which the engaging claws 68*f* of the engaging pieces 68*g* are inserted.

As shown in FIG. 3, on the side (upper side) of the reflection plate holding member 80 opposite from the light guide body 64, a unit cover (cover member) 38 made of sheet metal for shielding the light (external disturbance light) from outside the sensor unit 30 is provided. This makes it possible to prevent the light outside the sensor unit 30 from reaching the CIS 40 via the openings 80*a*.

Here, according to this embodiment, the lighting housing 67 is structured to be movable in such a direction (here, the up-down direction) as to move closer to and away from the CIS carriage main body 37. That is, the sensor unit 30 is structured such that the gap of the sheet conveying passage 12 changes as the lighting housing 67 moves up and down. When the lighting housing 67 moves up and down, the contact glass 42*b*, the lighting device 60, and the like also move up and down together with the lighting housing 67.

The lighting housing 67 is structured so as to be movable between the initial position (position in FIGS. 16 to 18, the lower limit position) where the gap (gap constituting the sheet conveying passage 12) between the top and bottom faces 12*a* and 12*b* of the sheet conveying passage 12 is the smallest and the fully expanded position (position in FIG. 19, the upper limit position) where the gap is the largest. The initial position is one example of a "first position" according to the present disclosure.

Figure 16:
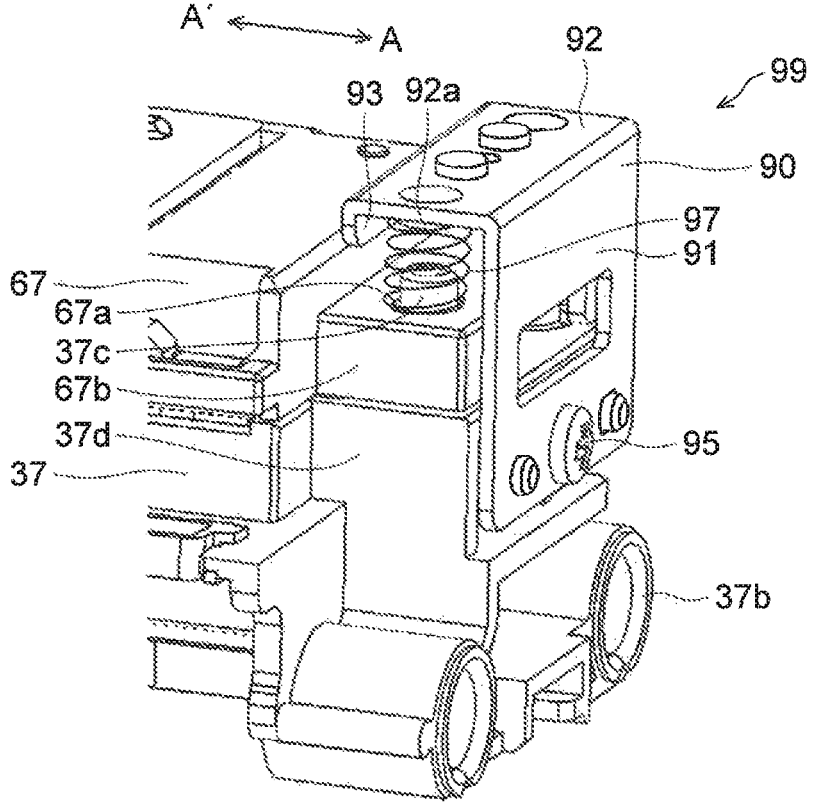
FIG. 16 is a perspective view showing the structure around a gap adjuster of the sensor unit according to the one embodiment of the present disclosure.
Figure 17:
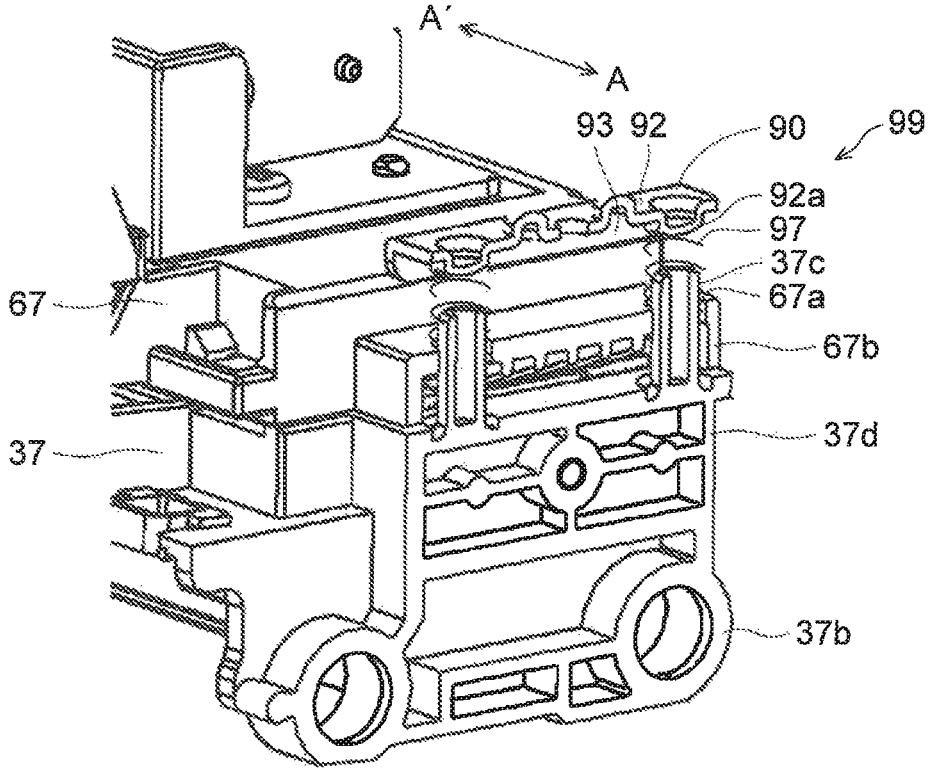
FIG. 17 is a cross-sectional perspective view showing the structure around the gap adjuster of the sensor unit according to the one embodiment of the present disclosure.
Figure 18:
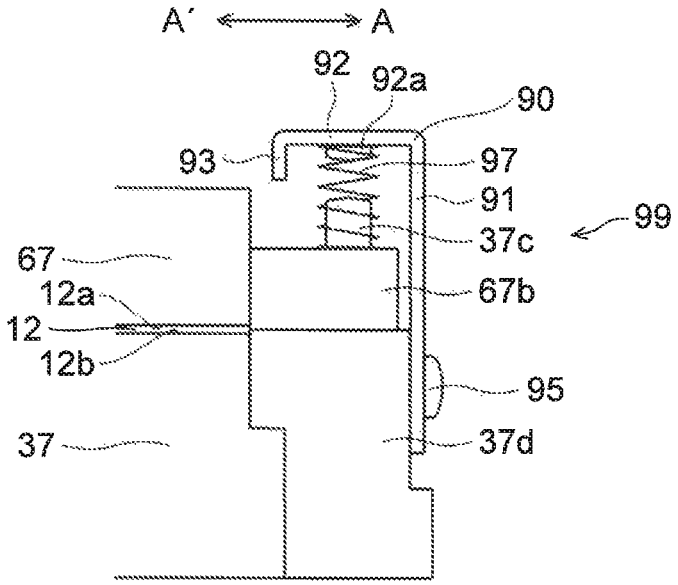
FIG. 18 is a diagram showing the structure around the gap adjuster of the sensor unit according to the one embodiment of the present disclosure, illustrating a state where the lighting housing is arranged at the initial position.

Specifically, as shown in FIGS. 16 to 18, at each end of the CIS carriage main body 37 in the sheet width direction (arrow AA' direction), an abutted portion 37*d* is integrally formed to which the bottom end of a guide shaft 37*c* extending in the up-down direction is fixed. In each end of the lighting housing 67 in the sheet width direction, a guide hole 67*a* in which the guide shaft 37*c* is inserted is formed, and the abutting portion 67*b* which can be slid along the guide shaft 37*c* in the up-down direction is integrally provided. The abutting portion 67*b* and the abutted portion 37*d* form a positioning portion for positioning the lighting housing 67 at the initial position.

To the abutted portion 37*d*, a regulation plate 90 made of sheet metal is fixed. The regulation plate 90 has a fixed portion 91 which is fixed to the outer face of the abutted portion 37*d* using screws 95 and which extends upward, a bent portion 92 which extends inward in the sheet width direction from the tip end (top end) of the fixed portion 91 and which faces the top face of the abutted portion 37*d*, and a bent piece 93 which extends downward from the inner end (left end in FIG. 16) of the bent portion 92. On the bent portion 92, a pair of bosses 92*a* is formed which protrudes downward and which is inserted in the top end of a biasing member 97 comprising a compression spring. The lower end of the biasing member 97 is fitted around the guide shaft 37*c* and biases the abutting portion 67*b* downward.

In a regular state, the bottom face of the abutting portion 67*b* abuts on the top face of the abutted portion 37*d* under the own weight of the lighting housing 67 and the like and under the biasing force of the biasing member 97. In this state, the gap of the sheet conveying passage 12 is the smallest, and the lighting housing 67 is arranged at the initial position (positions in FIGS. 16 to 18). The size of the gap of the sheet conveying passage 12 with the lighting housing 67 arranged at the initial position is taken as a reference value. The abutted portion 37*d* is a regulating portion which regulates the lower limit of the moving range of the lighting housing 67.

Figure 19:
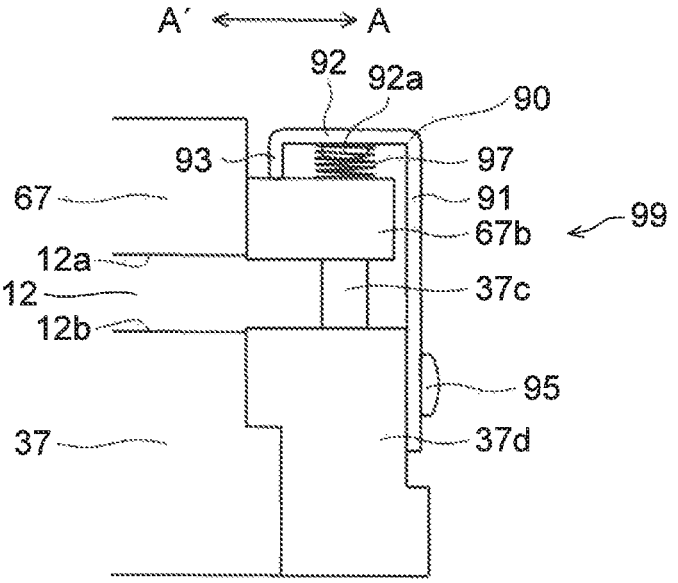
FIG. 19 is a diagram showing the structure around the gap adjuster of the sensor unit according to the one embodiment of the present disclosure, illustrating a state where the lighting housing is arranged at the fully expanded position.

When, with the lighting housing 67 arranged at the initial position, for example, a sheet of cardboard with a thickness greater than the size of the gap (reference value) of the sheet conveying passage 12 passes through the sheet conveying passage 12, the cardboard makes contact with the bottom face of the lighting housing 67 (or the contact glass 42*b*) to push up the lighting housing 67, the contact glass 42*b*, and the like. This widens the gap of the sheet conveying passage 12. As shown in FIG. 19, the upward movement of the lighting housing 67 is regulated by the bent piece 93. That is, the bent piece 93 is a regulation portion which regulates the upper limit of the moving range of the lighting housing 67.

In this way, the biasing member 97, the regulation plate 90, the guide shaft 37*c*, the abutted portion 37*d*, the abutting portion 67*b*, and the like constitute a gap adjuster 99 which supports the lighting housing 67 movably between the initial position and the fully expanded position.

Figure 20:
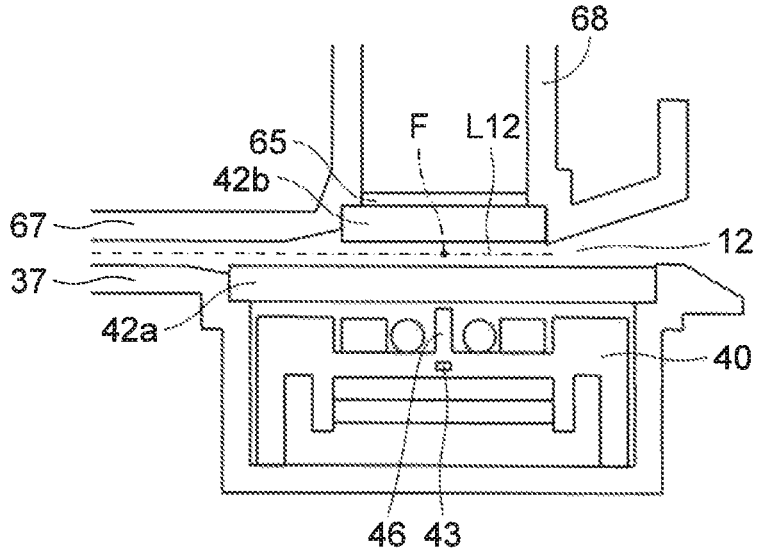
FIG. 20 is a cross-sectional side view showing the structure around the gap adjuster of the sensor unit according to the one embodiment of the present disclosure, illustrating a state where the lighting housing is arranged at the initial position.

In this embodiment, as shown in FIG. 20, the focal position F of the CIS 40 with the lighting housing 67 arranged in the initial position is located at the center L12 of the gap of the sheet conveying passage 12. The focal position F denotes the position (point) in the best focus.

Figure 21:
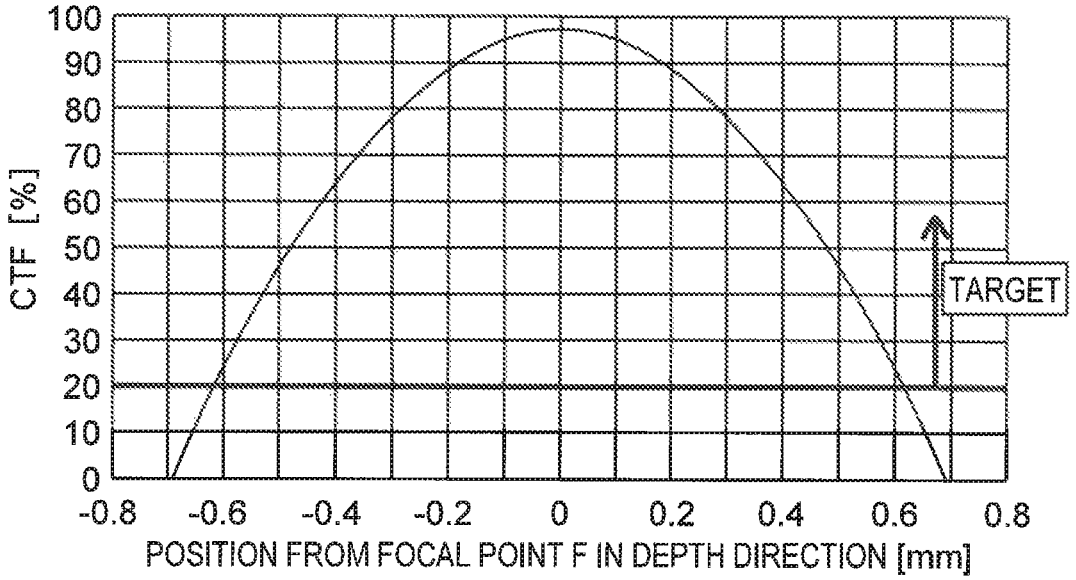
FIG. 21 is a diagram showing the CTF characteristics of the CIS of the sensor unit according to the one embodiment of the present disclosure.

FIG. 21 is a diagram showing a CIF (contrast transfer function) in a range of ±0.8 mm in the depth direction relative to the focal position F of the CIS 40. When the target CTF is set at 20% or higher, the focal range of the CIS 40 is a range of ±0.62 mm in the depth direction relative to the focal position F. Thus, in this embodiment, by arranging the focal position F of the CIS 40 at the center L12 of the gap of the sheet conveying passage 12, it is possible to widen the gap of the sheet conveying passage 12 with the lighting housing 67 arranged at the initial position up to about 1.2 mm. The focal range denotes the range in focus in the depth direction.

Figure 22:
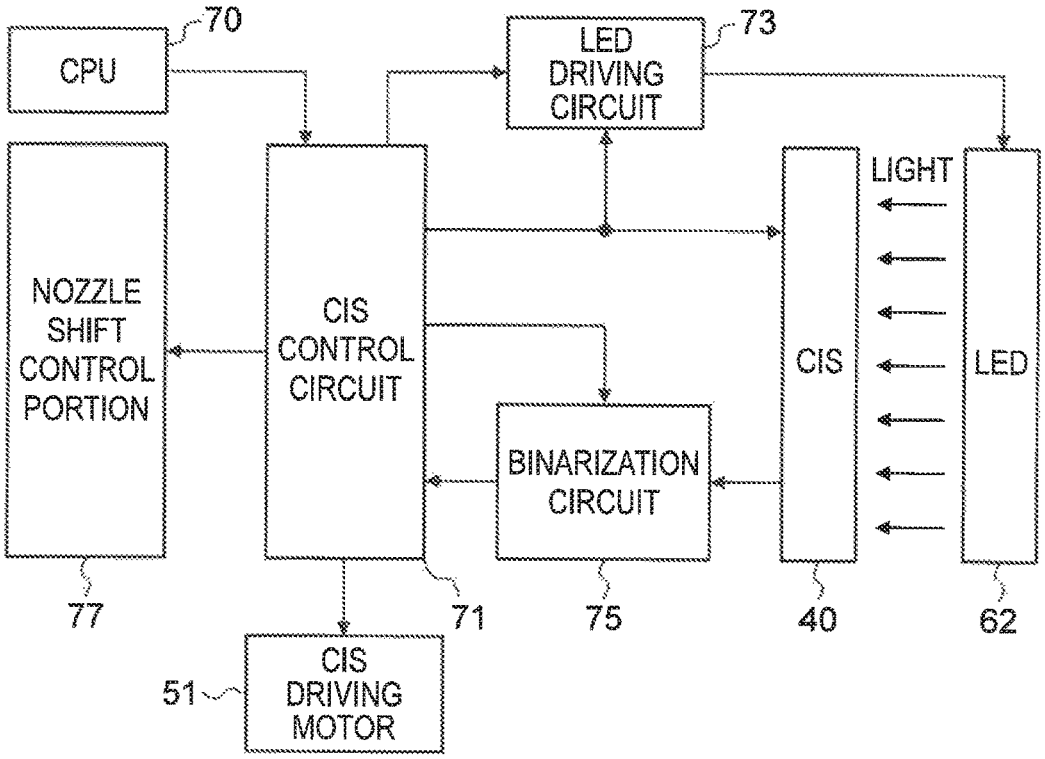
FIG. 22 is a block diagram showing the control paths of the printer according to the one embodiment of the present disclosure.

FIG. 22 is a block diagram showing the control paths of the printer 100 of this embodiment. A CPU 70 controls the whole printer 100 comprehensively. When the printer 100 starts printing operation on a sheet P based on printing data received from an external computer or the like, the CPU 70 makes various settings on a CIS control circuit 71 for reading signals from the CIS 40. The CPU 70, based on sheet size information included in the received printing data, transmits a control signal to a CIS driving motor 51 (see FIG. 2) of the carriage moving mechanism 50 and makes the CIS carriage main body 37 in the sensor unit 30 move by a predetermined distance.

The CIS control circuit 71, according to the settings made by the CPU 70, sends to the CIS 40 a reference clock signal for reading a signal from the CIS 40 and an accumulation time determination signal for determining the electric charge accumulation time in the CIS 40. The CIS control circuit 71 sends a PWM signal to an LED driving circuit 73 for setting the value of a current to pass in the LED 62. The LED driving circuit 73 generates a direct-current voltage in accordance with the PWM signal from the CIS control circuit 71 and makes it a reference voltage of the current to pass in the LED 62. The CIS control circuit 71 generates a comparison reference voltage (threshold voltage) for binarizing in a binarization circuit 75 an analogue signal (output signal) from the CIS 40.

At the timing when a sheet P in a standby state at the registration roller pair 13 (see FIG. 3) is about to be conveyed toward the recording portion 9 (see FIG. 1), the CPU 70 instructs the CIS control circuit 71 to sense the side edge. On receiving the instruction from the CPU 70 to sense the side edge, the CIS control circuit 71 synchronizes with an accumulation time determination signal and sends to the LED driving circuit 73 a control signal for turning on the LED 62. The LED driving circuit 73, according to the control signal from the CIS control circuit 71, turns on the LED 62 for a given period.

In response to the next accumulation time determination signal and reference clock signal, the CIS 40 outputs a voltage equivalent to the quantity of light accumulated while the LED 62 is on in each pixel (photoelectric conversion element) in a pixel group of the light receiving portion 43 one pixel at a time as an output signal. The output signal output from the CIS 40 is binarized in the binarization circuit 75 by being compared with the comparison reference voltage (threshold voltage) and is input to the CIS control circuit 71 as a digital signal.

The CIS control circuit 71, for each output signal output by the CIS 40, checks whether the value of the digital signal binarized in the binarization circuit 75 is 0 or 1 sequentially one pixel at a time. Then, the CIS control circuit 71 senses the position (position of the photoelectric conversion element) of the pixel in the light receiving portion 43 where the value of the digital signal changes from 0 to 1 or from 1 to 0.

When the CIS control circuit 71 senses the position of the pixel where the value of the digital signal has changed, the position of the changed pixel is determined to be the edge position of a sheet P in its width direction. The CPU 70 calculates the amount of deviation between the edge position determined by the CIS control circuit 71 and the edge position (reference edge position) when a sheet P is conveyed at an ideal conveying position (reference conveying position) where the sheet P passes along the center position of the sheet-passing region. The calculated deviation amount is transmitted to a nozzle shift control portion 77, The nozzle shift control portion 77, according to the transmitted deviation amount of a sheet P in its width direction, shifts the use region of ink ejecting nozzles of the line heads 10C to 10K in the recording portion 9. The nozzle shift control portion 77 is one example of "control portion" according to the present disclosure.

In this embodiment, as described above, when, with the lighting housing 67 arranged at the initial position, a sheet P (cardboard etc.) with a thickness greater than the size (reference value) of the gap of the sheet conveying passage 12 passes through the sheet conveying passage 12, the lighting housing 67 moves in a direction away from the CIS carriage main body 37 as the sheet P enters the sheet conveying passage 12, to allow the passage of the sheet P. This helps widen the gap when a sheet P thicker than the size of the gap of the sheet conveying passage 12 passes through the sheet conveying passage 12 to prevent the conveyance resistance from becoming too high. Thus, it is possible to suppress conveyance failure.

The lighting housing 67 is movable from the initial position in a direction in which the size of the gap increases from the reference value, and thus it is possible to prevent the gap of the sheet conveying passage 12 with the lighting housing 67 arranged at the initial position from becoming too large. In other words, there is no need to set the gap of the sheet conveying passage 12 at the maximum thickness (for example, 2 to 3 mm) of sheets. Thus, even when a thin sheet P such as regular paper is conveyed along the top face 12*a* or the bottom face 12*b* with the lighting housing 67 arranged at the initial position, it is possible to prevent the CIS 40 from losing focus on the sheet P. Thus, it is possible to prevent the sensing accuracy of the side edge of the sheet P from lowering.

As described above, the focal position F of the CIS 40 with the lighting housing 67 arranged at the initial position is set at the center L12 of the gap of the sheet conveying passage 12. This makes it possible to set the initial position of the lighting housing 67 such that the size of the gap of the sheet conveying passage 12 is about the same as the focal range of the CIS 40. This helps increase the gap of the sheet conveying passage 12 with the lighting housing 67 arranged at the initial position, and thus it is possible to further prevent the conveyance resistance for conveying the sheet P from becoming too high.

As described above, the CIS 40 is held by the CIS carriage main body 37. Thus, unlike in a case where the CIS 40 is held by the lighting housing 67, there is no need to move (push up) the CIS 40 to widen the gap of the sheet conveying passage 12 (of the lighting housing 67 and the CIS 40, only the lighting housing 67 needs to be pushed up), and thus it is possible to further prevent the conveyance resistance from becoming too high.

As described above, the biasing member 97 is a compression spring arranged between the bent portion 92 and the abutting portion 67*b*. This makes it possible to easily adjust the load when the CIS 40 is pushed up.

As described above, on the CIS carriage main body 37, a guide shaft 37*c* which extends along the moving direction of the lighting housing 67 is provided. In the abutting portion 67*b*, the guide hole 67*a* for inserting the guide shaft 37*c* is provided. This makes it possible to easily move the lighting housing 67 in the thickness direction of the sheet conveying passage 12.

As described above, the lighting device 60 is provided which is arranged on the side opposite from the CIS 40 with respect to the sheet conveying passage 12 and which emits light toward the CIS 40. This makes it possible to sense the side edge of the sheet P in the width direction based on the difference in the intensity of the light received by the CIS 40 according to the presence or absence of the sheet P, and thus, regardless of the color of the sheet P, it is possible to reliably sense the side edge of the sheet P in the width direction. When the lighting device 60 is arranged on the same side as the CIS 40 with respect to the sheet conveying passage 12, it may not be possible to sense the side edge in the width direction depending on the color of the sheet P. Specifically, when, for example, the sheet P is white and the area outside the sheet P (non-sheet P passage area) is black, the intensity difference between the light reflected from the sheet P and the light reflected from the non-passage area is large, and thus, the side edge of the sheet P in the width direction is sensed by the CIS 40. On the other hand, when, for example, the sheet P is black and the non-passage area is also black, the intensity difference between the light reflected from the sheet P and the light reflected from the non-sheet P passage area is small, and thus, the side edge of the sheet P in the width direction cannot be sensed by the CIS 40.

As described above, based on the edge position of the sheet P sensed by the sensor unit 30, the position of the image on the sheet P is corrected. This makes it possible to easily prevent the deviation of the image position with respect to the sheet P, and thus, degradation of the image quality can be easily prevented.

The embodiment described above is in no way meant to limit the present disclosure, which thus allows for many modifications and variations within the spirit of the present disclosure. For example, although the above embodiment deals with an example where the CIS 40 is used as a sensor for sensing the side edge of a sheet P, any sensor other than a CIS, such as a CCD, may be used.

Although the embodiment described above deals with, as an example, a printer 100 of an ink-jet recording type which ejects ink onto a sheet P from ink ejection nozzles of line heads 10C to 10K to record an image, the present disclosure is not limited to printers 100 of an ink-jet recording type. Instead, the present disclosure may be applied, for example, to image forming apparatuses of an electrophotographic type which emits a laser beam onto an image carrier such as a photosensitive drum to form an electrostatic latent image, attach toner to the electrostatic latent image to form a toner image, transfer the toner image onto a sheet, and apply heat and pressure to the transferred unfixed toner to form a permanent image.

Although the above embodiments deal with an example where the CIS 40 is held by the CIS carriage main body 37 (second housing), this is in no way meant to limit the present disclosure. Instead, the CIS 40 may be held by the lighting housing 67 (first housing). That is, the CIS 40 may move together with the first housing.

Although the above embodiments deal with an example where the lighting housing 67 (first housing) arranged over the sheet conveying passage 12 moves in the up-down direction, this is in no way meant to limit the present disclosure. Instead, the CIS carriage main body 37 arranged under the sheet conveying passage 12 may move in the up-down direction. In this case, the CIS carriage main body 37 corresponds to the "first housing" of the present disclosure, and the lighting housing 67 corresponds to the "second housing" of the present disclosure.

Although the above embodiments deal with an example where the lighting device 60 is arranged on the side opposite from the CIS 40 with respect to the sheet conveying passage 12, this is in no way meant to limit the present disclosure. The lighting device 60 may be arranged on the same side as the CIS 40 with respect to the sheet conveying passage 12 to read the reflected light reflected by the sheet P by the CIS 40.

Figure 23:
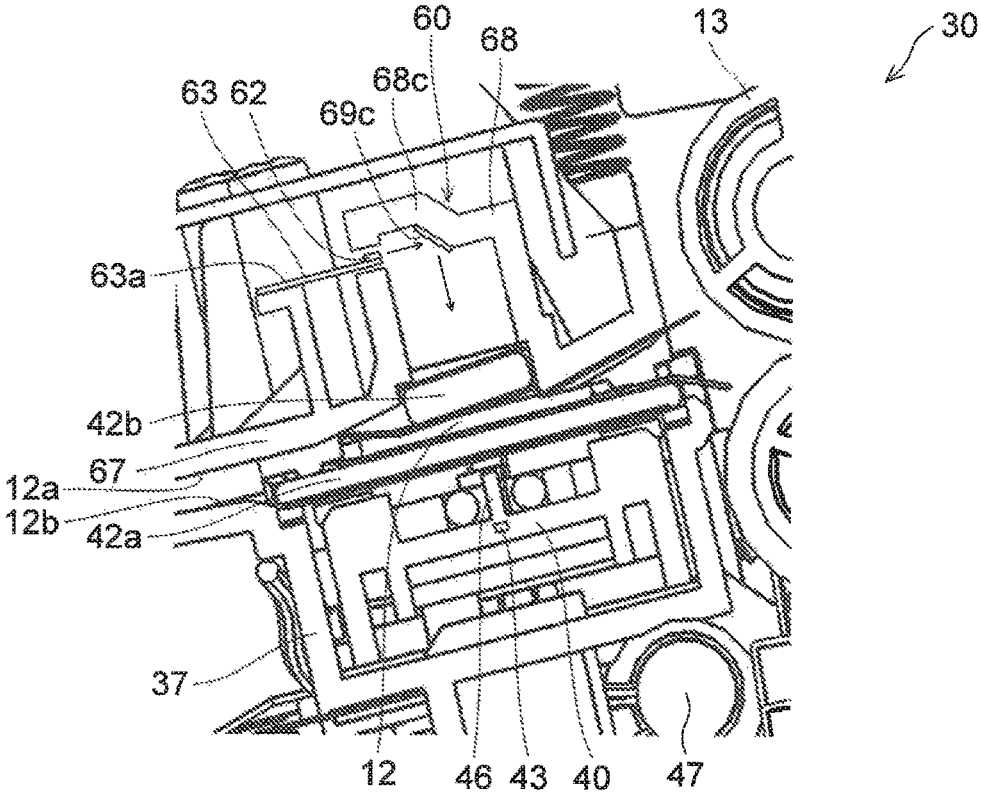
FIG. 23 is a cross-sectional side view showing the structure around the lighting device of the sensor unit according to the one embodiment of the present disclosure.

Although the above embodiments deal with an example where the light guide body 64 is provided which shines light perpendicularly with respect to the sheet conveying passage 12, this is in no way meant to limit the present disclosure. Instead, the light guide body 64 does not necessarily be provided. In this case, as in the sensor unit 30 shown in FIG. 23 as a modified example of the present disclosure, the LED 62 may be arranged so as to emit the light along the sheet conveying direction (substantially parallel to the sheet conveying passage) or the light from the LED 62 may be reflected toward the CIS 40 using the reflection plate 69*c*.

Any configurations achieved by combining the configurations of the embodiments and modified examples described above are also within the technical scope of the present disclosure.

What is claimed is:

1. A sensor unit comprising:

a sheet conveying passage through which a sheet is conveyed;

a first housing which extends in a width direction perpendicular to a conveying direction of the sheet and which constitutes a first conveying face of the sheet conveying passage;

a second housing which extends in the width direction and which constitutes a second conveying face of the sheet conveying passage arranged opposite the first conveying face with a predetermined gap;

an edge detection sensor which is arranged in one of the first and second housings and which detects a side edge, along the conveying direction, of the sheet passing through the sheet conveying passage; and a gap adjuster which supports the first housing movably from a first position where a size of the gap equals a reference value in a direction in which the size of the gap increases from the reference value, wherein when, with the first housing arranged at the first position, a sheet with a thickness greater than the reference value passes through the sheet conveying passage, the first housing moves in the direction in which the size of the gap increases as the sheet enters the sheet conveying passage, to allow passage of the sheet, and with the first housing arranged at the first position, a focal position of the edge detection sensor is located at a center of a size of the gap of the sheet conveying passage.

2. A sensor unit comprising:

a sheet conveying passage through which a sheet is conveyed;

a first housing which extends in a width direction perpendicular to a conveying direction of the sheet and which constitutes a first conveying face of the sheet conveying passage;

a second housing which extends in the width direction and which constitutes a second conveying face of the sheet conveying passage arranged opposite the first conveying face with a predetermined gap;

an edge detection sensor which is arranged in one of the first and second housings and which detects a side edge, along the conveying direction, of the sheet passing through the sheet conveying passage; and a gap adjuster which supports the first housing movably from a first position where a size of the gap equals a reference value in a direction in which the size of the gap increases from the reference value, wherein when, with the first housing arranged at the first position, a sheet with a thickness greater than the reference value passes through the sheet conveying passage, the first housing moves in the direction in which the size of the gap increases as the sheet enters the sheet conveying passage, to allow passage of the sheet, and the gap adjuster includes a positioning portion which has an abutting portion provided at each end of the first housing in the width direction, and an abutted portion which is provided at each end of the second housing in the width direction and which is abuttable on the abutting portion, the positioning portion positioning the first housing at the first position as a result of the abutting portion making contact with the abutted portion, and a biasing portion which biases the first housing toward the first position.

3. The sensor unit according to claim 2, wherein the second housing is provided with a regulation plate having a fixed portion which is fixed to an outer face of the abutted portion in the width direction and a bent portion which is bent from an upper end edge of the fixed portion inward in the width direction to face a top face of the abutted portion, and the biasing member is a compression spring which is arranged between the bent portion and abutting portion.

4. The sensor unit according to claim 3, wherein the abutted portion is provided with a guide shaft which extends from the top face along a moving direction of the first housing, and the abutting portion has a guide hole in which the guide shaft is inserted.

5. The sensor unit according to claim 3, wherein the bent portion has a bent piece which extends downward from an inner end thereof, and the bent piece makes contact with the top face of the abutting portion to regulate an upper limit of a moving range of the first housing.

6. The sensor unit according to claim 1, wherein the edge detection sensor is held by the second housing.

7. The sensor unit according to claim 1, further comprising a lighting device which is arranged in another of the first housing and the second housing and which emits light toward the edge detection sensor.

8. The sensor unit according to claim 7, wherein the lighting device is held by the first housing.

9. An image forming apparatus comprising:

the sensor unit according to claim 1;

an image forming portion which is arranged downstream of the sensor unit in the conveying direction and which forms an image on the sheet; and a control portion which corrects a position of the image on the sheet based on an edge position of the sheet detected by the sensor unit.

10. The sensor unit according to claim 2, wherein the edge detection sensor is held by the second housing.

11. The sensor unit according to claim 2, further comprising a lighting device which is arranged in another of the first housing and the second housing and which emits light toward the edge detection sensor.

12. The sensor unit according to claim 11, wherein the lighting device is held by the first housing.

13. An image forming apparatus comprising:

the sensor unit according to claim 2;

an image forming portion which is arranged downstream of the sensor unit in the conveying direction and which forms an image on the sheet; and a control portion which corrects a position of the image on the sheet based on an edge position of the sheet detected by the sensor unit.

* * * * *